US009044936B2

(12) United States Patent
Van Brocklin et al.

(10) Patent No.: US 9,044,936 B2
(45) Date of Patent: Jun. 2, 2015

(54) INKJET ISSUE DETERMINATION

(75) Inventors: Andrew L. Van Brocklin, Corvallis, OR (US); Adam L. Ghozeil, Corvallis, OR (US); Mark Hunter, Portland, OR (US); Scott A. Linn, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/372,697

(22) PCT Filed: Apr. 19, 2012

(86) PCT No.: PCT/US2012/034249

§ 371 (c)(1),
(2), (4) Date: Jul. 16, 2014

(87) PCT Pub. No.: WO2013/158105

PCT Pub. Date: Oct. 24, 2013

(65) Prior Publication Data

US 2015/0029250 A1 Jan. 29, 2015

(51) Int. Cl.

| | |
|---|---|
| ***B41J 29/393*** | (2006.01) |
| ***B41J 2/045*** | (2006.01) |
| ***B41J 2/14*** | (2006.01) |

(52) U.S. Cl.

CPC ..... *B41J 2/04541* (2013.01); *B41J 2/0451* (2013.01); *B41J 2/0458* (2013.01); *B41J 2/14153* (2013.01); *B41J 2002/14354* (2013.01)

(58) Field of Classification Search

CPC .... B41J 11/008; B41J 11/0095; B41J 25/308; B41J 2/07; B41J 2/04505; B41J 2202/07; B41J 2/165426; B41J 2/14145

See application file for complete search history.

(56) References Cited

U.S. PATENT DOCUMENTS

| | | | | |
|---|---|---|---|---|
| 7,686,442 | B2 * | 3/2010 | Katsumura | 347/92 |
| 7,717,531 | B2 | 5/2010 | Paasch | |
| 7,806,503 | B2 | 10/2010 | Aoki et al. | |
| 7,988,265 | B2 | 8/2011 | Smith | |
| 8,011,748 | B2 | 9/2011 | North et al. | |
| 8,690,302 | B2 * | 4/2014 | Paschkewitz et al. | 347/92 |
| 8,801,164 | B2 * | 8/2014 | Hays et al. | 347/92 |
| 2011/0084997 | A1 | 4/2011 | Chen et al. | |
| 2011/0148981 | A1 | 6/2011 | Chee et al. | |

FOREIGN PATENT DOCUMENTS

| | | | |
|---|---|---|---|
| JP | 11-334102 | A | 12/1999 |
| KR | 20070027269 | A | 3/2007 |
| KR | 20100130415 | A | 12/2010 |

* cited by examiner

*Primary Examiner* — Lamson Nguyen
(74) *Attorney, Agent, or Firm* — Van Cott, Bagley, Cornwall & McCarthy

(57) ABSTRACT

Determining an issue in an inkjet nozzle may include activating a drive bubble formation mechanism in an ink chamber to eject an ink droplet through the inkjet nozzle and measuring the drive bubble in the ink chamber after the drive bubble formation mechanism is activated.

15 Claims, 7 Drawing Sheets

INKJET ISSUE DETERMINATION

BACKGROUND

In inkjet printing, ink droplets are released from an array of nozzles in a print head onto a printing medium, such as paper. The ink bonds to a surface of the printing medium and forms graphics, text, or other images. The ink droplets are released with precision to ensure that the image is accurately formed. Generally, the medium is conveyed under the print head while the droplets are selectively released. The medium's conveyance speed is factored into the droplet release timing.

Some inkjet printers include print heads that slide laterally across a swath, or width, of the printing medium during a print job. In such printers, the medium's conveyance is halted momentarily as the print head travels and releases the predetermined droplets along the swath of the medium. Other inkjet printers include print heads that remain stationary throughout a printing job. In these printers, an array of nozzles generally spans the entire swath of the printing medium.

Print heads typically include a number of ink chambers, also known as firing chambers. Each ink chamber is in fluid communication with one of the nozzles in the array and provides the ink to be deposited by that respective print head nozzle. Prior to a droplet release, the ink in the ink chamber is restrained from exiting the nozzle due to capillary forces and/or back-pressure acting on the ink within the nozzle passage. The meniscus, which is a surface of the ink that separates the liquid ink in the chamber from the atmosphere located below the nozzle, is held in place due to a balance of the internal pressure of the chamber, gravity, and the capillary force. The size of the nozzle passage is a contributing factor to the strength of the capillary forces. The internal pressure within the ink chamber is generally insufficient to exceed the strength of the capillary force, and thus, the ink is prevented from exiting the ink chamber through the nozzle passage without actively increasing the pressure within the chamber.

During a droplet release, ink within the ink chamber is forced out of the nozzle by actively increasing the pressure within the chamber. Some print heads use a resistive heater positioned within the chamber to evaporate a small amount of at least one component of the liquid ink. In many cases, a major component of the liquid ink is water, and the resistive heater evaporates the water. The evaporated ink component or components expand to form a gaseous drive bubble within the ink chamber. This expansion exceeds the restraining force enough to expel a single droplet out of the nozzle. Generally, after the release of single droplet, the pressure in the ink chamber drops below the strength of the restraining force and the remainder of the ink is retained within the chamber. Meanwhile, the drive bubble collapses and ink from a reservoir flows into the ink chamber replenishing the lost ink volume from the droplet release. This process is repeated each time the print head is instructed to fire.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

As used herein, a drive bubble is a bubble formed from within an ink chamber to dispense a droplet of ink as part of a printing job or a servicing event. The drive bubble may be made of a vaporized ink separated from liquid ink by a bubble wall. The timing of the drive bubble formation may be dependent on the image to be formed on the printing medium.

The present specification describes principles including, for example, a method for determining an issue in an inkjet nozzle. The issue may include a blockage of the nozzle, the presence of a stray bubble in the ink chamber, a blockage of an inlet into the ink chamber, a weak drive bubble formation, other issues, or combinations thereof. Examples of such a method include activating a drive bubble formation mechanism in an ink chamber to eject a droplet of ink through the inkjet nozzle and measuring the drive bubble in the ink chamber after the drive bubble formation mechanism is activated. The measurements may be used to determine whether an issue exists and also determine the type of issue.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
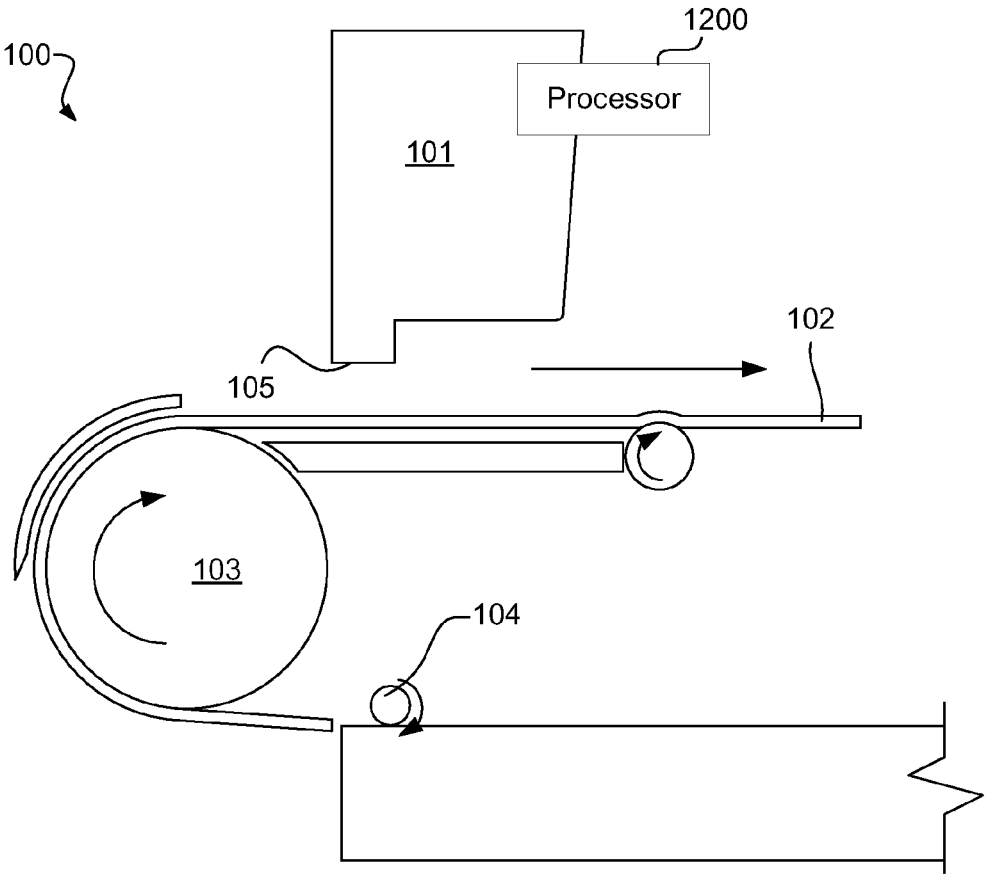
FIG. 1 is a diagram of illustrative components of a printer, according to principles described herein.

FIG. 1 is a diagram of illustrative components of a printer (100), according to principles described herein. In this example, the printer (100) includes a print head (101) positioned over a printing medium (102) traveling through the printer (100). The printer (100) further comprises a processor (1200) that is in communication with the print head (101) and is programmed to determine what issues the print head (101) is experiencing based, for example, on impedance measurements from the nozzles of the print head (101), as will be described in further detail below.

The printing medium (102) is pulled from a stack of media individually through the use of rollers (103, 104). In other examples, the printing medium is a continuous sheet or web.

The printing medium may be, but is not limited to, paper, cardstock, poster board, vinyl, translucent graphics medium, other printing media, or combinations thereof.

The print head (101) may have a number of nozzles formed in its underside (105). Each nozzle may be in electrical communication with a processor that instructs the nozzles to fire at specific times by activating a heater within the ink chambers associated with each nozzle. The heater may be a heating element, resistive heater, a thin-film resistor, or other mechanism that may create a bubble within the ink chamber. In other examples, a piezo-electric element may create pressure in the ink chamber to file a desired nozzle.

Figure 2:
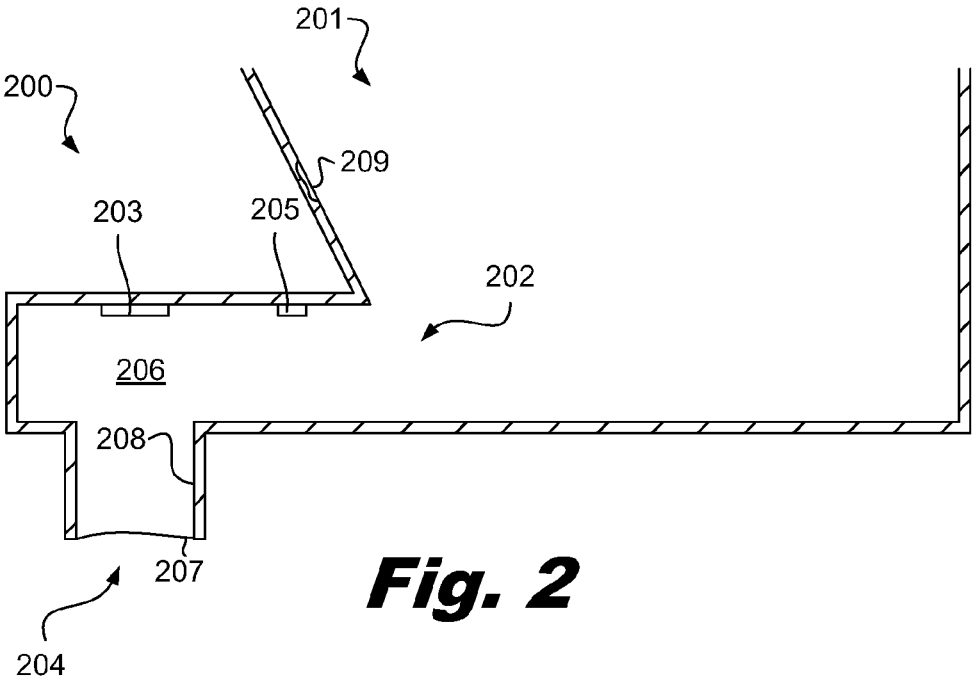
FIG. 2 is a cross sectional diagram of an illustrative ink chamber, according to principles described herein.

FIG. 2 is a cross sectional diagram of an illustrative ink chamber (200), according to principles described herein. In this example, the ink chamber (200) is connected to an ink reservoir (201) through an inlet (202). A heater (203) is positioned over the nozzle (204). An impedance sensor (205) is positioned near the heater (203). Capillary forces cause the ink to form a meniscus (207) within a passage (208) of the nozzle (204). The meniscus is a barrier between the liquid ink (206) in the chamber (200) and the atmosphere located below the nozzle (204). The internal pressure within the ink chamber (200) is not sufficient to move ink out of the chamber (200) unless the chamber's internal pressure is actively increased.

The impedance sensor (205) may have a plate made of a material of a predetermined resistance, such as a metal. In some examples, the metal plate is made of tantalum, copper, nickel, titanium, or combinations thereof. In some examples, the metal is capable withstanding corrosion due to the metal's contact with the liquid ink (206). A ground element (209) may also be located anywhere within the ink chamber (200) or ink reservoir (201). In the example of FIG. 2, the ground element (209) is depicted in the ink reservoir (201). In some examples, the ground element is an etched portion of a wall with a grounded, electrically conductive material exposed. In other examples, the ground element (209) may be a grounded electrical pad. When, in the presence of liquid ink (206), a voltage is applied to the impedance sensor (205), an electrical current may pass from the impedance sensor (205) to the ground element (209).

The liquid ink (206) may be more conductive than the air or other gasses in the drive bubble. In examples where the liquid ink contains some partly aqueous vehicle mobile ions, and a portion of the sensor's surface area is in contact with the liquid ink (206) when a current pulse or voltage pulse is applied to the sensor (205), the sensor's impedance is lower than it would otherwise be without the ink's contact. On the other hand, when an increasingly larger amount of the sensor's surface area is in contact with the gases of a drive bubble and a voltage or current of the same strength is applied to the sensor (205), the sensor's impedance increases. The sensor (205) may be used to make a measurement of some component of impedance, such as the resistive (real) components at a frequency range determined by the type of voltage source supplying the voltage or current to the sensor. In some examples, a cross sectional geometry of the drive bubble or stray bubbles along the electrical path between the impedance sensor (205) and the ground element (209) may also affect the impedance value.

FIGS. 3-6 depict an illustrative inkjet nozzle with a healthy condition during an ink droplet release. A healthy inkjet nozzle is a nozzle that is associated with an ink chamber, heater, and other components that are free of issues that would cause the nozzle to fire improperly. An improperly firing nozzle includes a nozzle that fails to fire at all, fires early, fires late, releases too much ink, releases too little ink, or combinations thereof.

FIGS. 3-6 depict the stages of the drive bubble from its formation to its collapse. These depictions are merely illustrative. Bubble size and geometry are determined by the factors such as an amount of heat generated by the heater, the internal pressure of the ink chamber, the amount of ink in the ink reservoir, the viscosity of the liquid ink, the ion concentration of the ink, the geometry of the ink chamber, volume of the ink chamber, the diameter size of the nozzle passage, the position of the heater, other factors, or combinations thereof.

Figure 3:
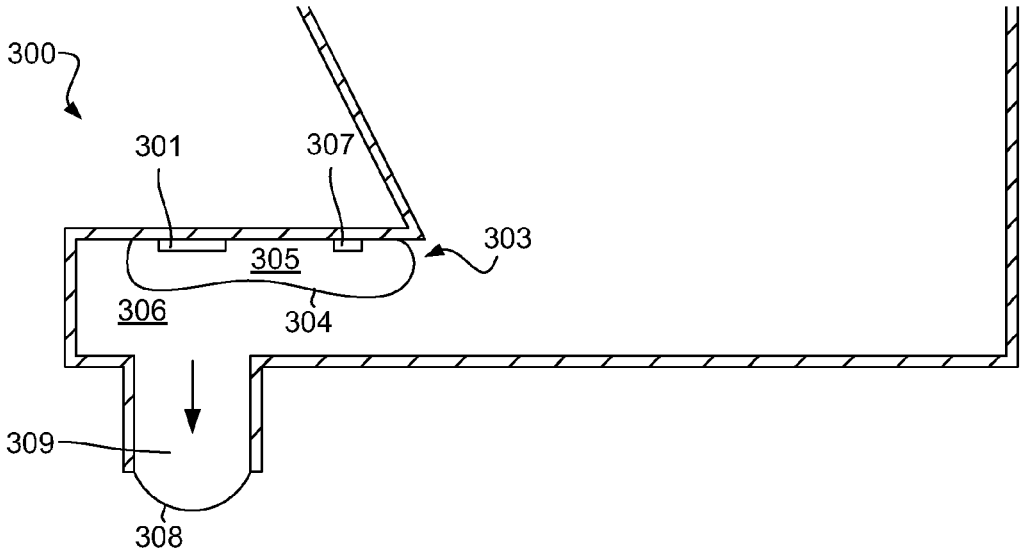
FIG. 3 is a cross sectional diagram of an illustrative ink chamber, according to principles described herein.

FIG. 3 is a cross sectional diagram of an illustrative ink chamber (300), according to principles described herein. In FIG. 3, a heater (301) in the ink chamber (300) is initiating drive bubble formation. A voltage is applied to the heater (301), and the heater's material resists the associated current flow driven by the voltage resulting in Joule heating. This heats the heater's material to a temperature sufficient to evaporate liquid ink in contact with the heater (301). As the ink evaporates, the ink in gaseous form expands forming a drive bubble (303). A bubble wall (304) separates the bubble's gas (305) from the liquid ink (306). In FIG. 3, the drive bubble (303) has expanded to such a volume that the heater (301) and the sensor (307) make physical contact just with the bubble's gas (305). Since the sensor is in contact with the bubble's gas (305), the sensor (307) measures an impedance value that indicates the drive bubble (303) is in contact with the sensor (307).

The expansion of the drive bubble (303) increases the internal pressure of the ink chamber (300). At the drive bubble size depicted in FIG. 3, the chamber's internal pressure displaces enough ink to force the meniscus (308) within the nozzle's passage (309) to bow outward. However, at this stage, inertia continues to keep all of the liquid ink (306) together.

Figure 4:
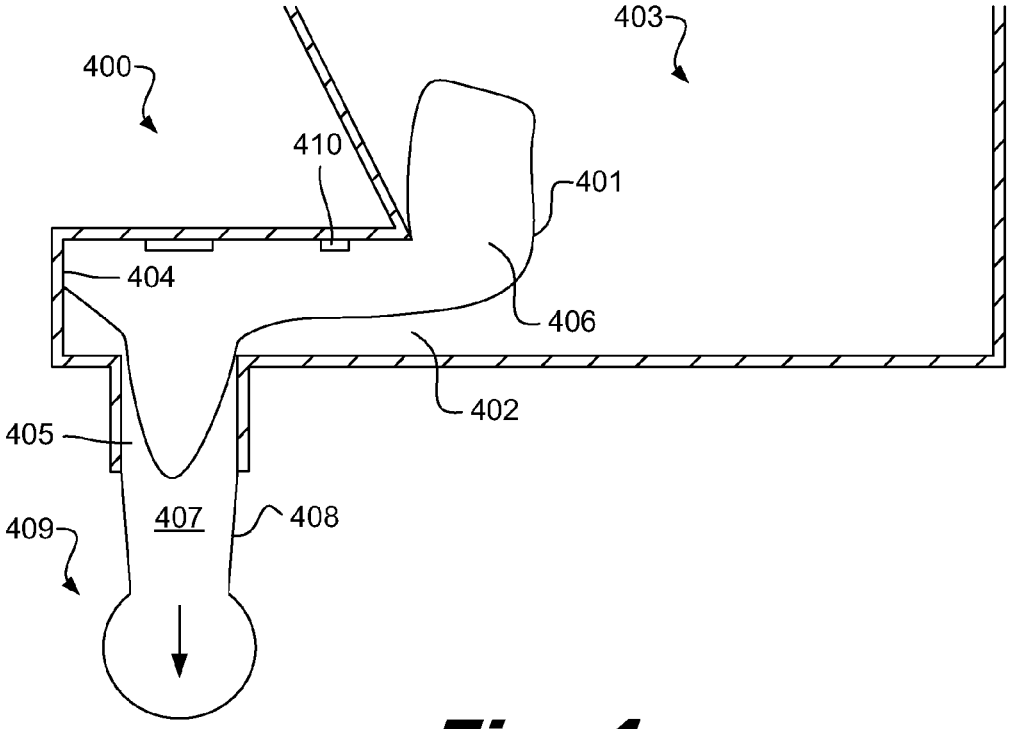
FIG. 4 is a cross sectional diagram of an illustrative ink chamber, according to principles described herein.

FIG. 4 is a cross sectional diagram of an illustrative ink chamber (400), according to principles described herein. In this figure, more time has passed from the initiation of the drive bubble, and the drive bubble's volume has continued to increase. At this stage, the drive bubble wall (401) extends through a chamber inlet (402) into an ink reservoir (403). On the other side of the chamber, the bubble wall (401) makes contact with the chamber's far wall (404). Another portion of the bubble wall (401) enters into the nozzle passage (405).

The drive bubble (406) may substantially isolate the liquid ink (407) in the chamber passage (405) from the rest of the ink chamber (400). As the drive bubble (406) continues to expand into the nozzle passage (405), the pressure in the nozzle passage (405) increases to such a degree that the liquid ink (407) in the passage (405) pushes the meniscus (408) out of the nozzle passage (405) increasing the meniscus's surface area. As the meniscus (408) increases in size, a droplet (409) forms that pulls away from the passage (405).

At this stage, the drive bubble (406) continues to cover the entire surface area of the sensor (410). Thus, the sensor (410) may measure the drive bubble's presence by measuring a higher resistance or impedance that the sensor (410) would otherwise measure if the sensor (410) were in contact with liquid ink (407).

Figure 5:
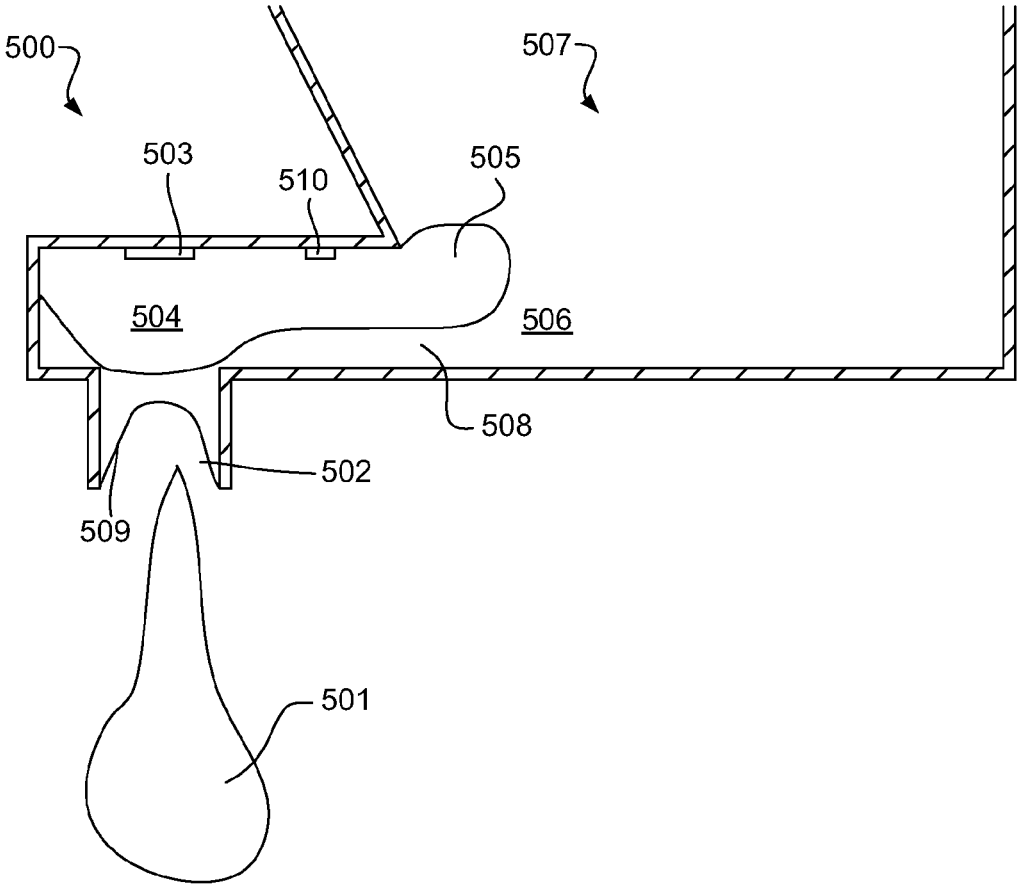
FIG. 5 is a cross sectional diagram of an illustrative ink chamber, according to principles described herein.

FIG. 5 is a cross sectional diagram of an illustrative ink chamber (500), according to principles described herein. In this example, the ink droplet (501) is breaking free from the nozzle passage (502) and the heater (503) is deactivating.

At this stage, the gas (504) of the drive bubble (505) cools in the absence of the heat from the heater (503). As the gas (504) cools, the drive bubble (505) shrinks, which depressurizes the ink chamber (500). The depressurization pulls liquid ink (506) from the ink reservoir (507) into chamber (500) through the chamber inlet (508) to replenish the ink volume lost to the droplet release. Also, the meniscus (509) is pulled back into nozzle passage (502) due to the depressurization. The sensor (510) continues to measure a comparatively high impedance value because the drive bubble (505) continues to isolate the sensor (510) from the liquid ink (506).

Figure 6:
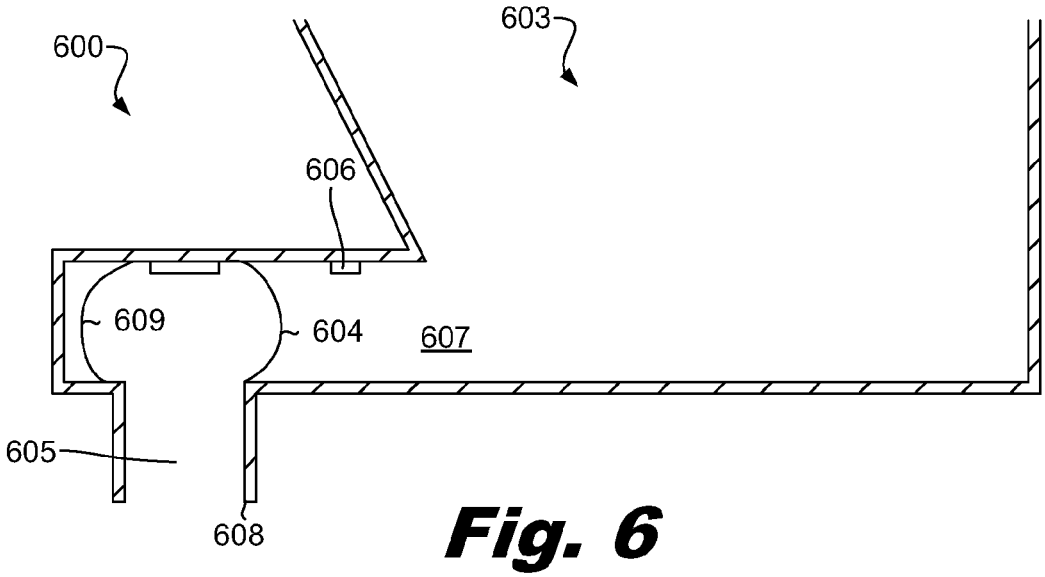
FIG. 6 is a cross sectional diagram of an illustrative ink chamber, according to principles described herein.

FIG. 6 is a cross sectional diagram of an illustrative ink chamber (600), according to principles described herein. In this figure, the drive bubble merges with the meniscus. As the internal pressure of the ink chamber (600) increases due to the ink flow from the reservoir (603), the bubble wall (604) is forced back towards the nozzle passage (605). During this bubble wall retraction, the reservoir side bubble wall (604) pulls away from the sensor (606). As the sensor (606) reestablishes contact with the liquid ink (607), the sensor measures a lower impedance value due to the higher electrical conductivity of the liquid ink (607).

At this stage under healthy operating conditions, the reservoir side bubble wall (604) resists a greater amount of pressure than the far wall bubble wall (609) due to the ink flow from the ink reservoir (603) reestablishing a pressure equilibrium in the ink chamber (600). The ink flow replenishes the lost ink volume, and the meniscus moves to the end (608) of the nozzle passage (605).

Again, FIGS. 3-6 depict an example of an illustrative inkjet nozzle with a healthy condition during an ink droplet release. However, many conditions may adversely affect the droplet release. For example, a blockage of the nozzle passage may prevent the formation of an ink droplet. The measurement results when a nozzle is blocked in this way may show that the drive bubble forms normally, but that the drive bubble collapses more slowly than expected.

In other examples, a blockage of the ink chamber inlet may prevent ink from flowing from the ink reservoir to reestablish equilibrium within the ink chamber. In such a situation, the liquid ink may fail to come back into contact with the sensor. In other cases, the ink never enters the chamber during the priming process.

Blockages in either the inlet or nozzle passage may occur due to particles in the ink or solidified portions of the ink. The ink may solidify from exposure to air in the nozzle passage or from heating from the heater. Generally, ink chambers have a volume in the picoliter scale, thus, very small particles may partially or completely form blockages within the ink chamber.

In some cases, liquid ink may dry and solidify on the heater and become a thermal barrier that inhibits the heater's ability to vaporize the liquid ink. The thermal barrier may completely hinder the heater's ability to form a drive bubble or limit the heater to forming a smaller, weaker drive bubble than desired.

Also, the presence of a stray bubble may affect the ink droplet release. Since droplet release timing effects the accuracy of the image formed on the printing medium, the latency from initiating the drive bubble formation to the actual droplet release needs to be predictable. Sometimes air bubbles form in either the body of the ink in the ink reservoir or in the chamber itself due to air or other gasses out-gassing from the ink. In some cases, this causes a semi-permanent stray bubble of gas to be created in or migrate towards the inkjet chamber. Such a stray bubble may reside in the ink chamber. The presence of these stray bubbles within the ink chamber may affect the overall compressive condition of the ink. For example, the mechanical compliance of a stray bubble may absorb some of the internal pressure intended to displace ink out of the nozzle passage and delay the droplet release. Further, a stray bubble's wall may deflect the drive bubble away from the nozzle passage in such a manner that the droplet fails to form or forms more slowly.

In some examples, the ink flow from the reservoir may fail to establish a pressure equilibrium near the chamber's far wall and allow a residual bubble to remain in the ink chamber after the drive bubble has collapsed. In other examples, the ink may become frothy resulting in the formation of a plurality of miniature air bubbles in the liquid ink. The froth may be formed due to an air leak into the reservoir, a contaminant in the ink, an unintended mechanical agitation that mixes air from the nozzle passageway with the ink in the chamber, another mechanism, or combinations thereof. The froth may also be formed from a failed priming process that allows air to leak into the chamber as bubbles.

Due to the variety of effects that stray bubbles may have on a nozzle's health, the sensor may make inconsistent measurements. For example, frothy ink may measure as having a higher impedance value while in contact with the liquid ink due to some contact with the small air bubbles. In situations where a larger stray bubble is present, the liquid ink may fail to rewet the sensor's plate.

As will be explained in more detail below, these various issues will have differentiating characteristics as measured by the sensor (e.g. 205 in FIG. 2) in the ink chamber. For example, the life span of a drive bubble as measured by the sensor can indicate which, if any, of these various issues is occurring. Consequently, the output from that sensor can be used to determine which of the various issues described is occurring in a particular nozzle of the print head.

Figure 7:
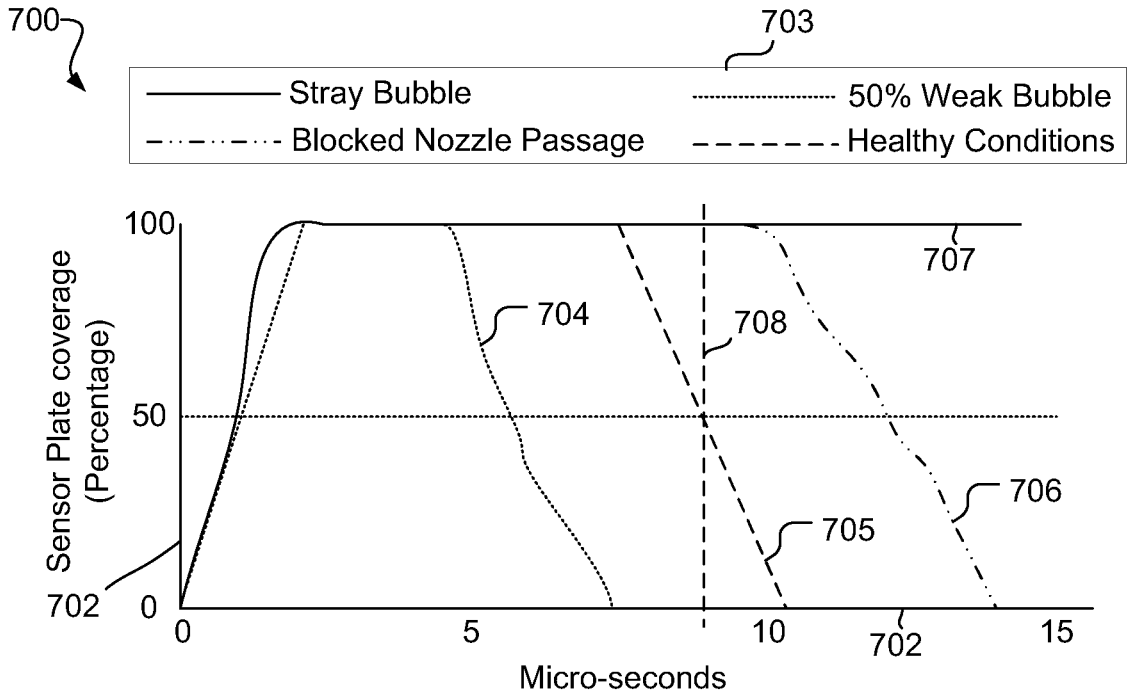
FIG. 7 is a diagram of an illustrative chart showing bubble life spans, according to principles described herein.

FIG. 7 is an illustrative chart (700) showing bubble life spans, according to principles described herein. In this example, the x-axis (701) schematically represents time in microseconds. Zero microseconds may correspond to the initiation of the drive bubble formation. The y-axis (702) may schematically represent the drive bubble's coverage of the sensor plate's surface area, which corresponds to the real portion of the impedance measurement.

The drive bubble's coverage depicted on the y-axis (702) may correspond to a component of the impedance measurement taken by the sensor in the ink chamber. For example, a minimum impedance measurement may indicate that the entire surface area of the sensor is in contact with the ink and may correspond to zero percent surface area coverage on the y-axis (702). On the other hand, a maximum impedance measurement may indicate that the entire surface area of the sensor is in contact with the drive bubble and may correspond to a hundred percent surface area coverage on the y-axis (702). Impedance measurements between the minimum and maximum may indicate that a portion of the sensor's surface area is covered with liquid ink and another portion is covered by the drive bubble. In some examples, a higher impedance measurement indicates that a greater portion of the surface area is covered by the drive bubble. On the other hand, a lower impedance measurement may indicate that a majority of the surface area is a covered by liquid ink.

A legend (703) indicates which lines (704, 705, 706, 707) are associated with specific nozzle conditions, such as a healthy condition, a weak bubble, a blocked nozzle passage, and the presence of a stray bubble. The values of this chart (700) may be experimentally determined prior to a print job and may be specific to ink chambers of like geometry, size, etc.

During a print job, the sensor may take a measurement to determine whether and to what extent the sensor is in contact with liquid ink or the drive bubble. For example, if the sensor is instructed to take a measurement at nine microseconds (708) and the sensor takes an impedance measurement between the minimum and maximum, this will indicate that the nozzle condition is healthy. In the example of FIG. 7, the impedance measurement at nine microseconds may correspond to being about half way between the minimum and the maximum values, which may indicate that approximately half of the sensor plate is covered with the drive bubble and the other half is covered with liquid ink.

However, if the sensor measures the minimum impedance value at nine microseconds, which may correspond to zero percent surface area coverage on the y-axis (702), this may indicate that the heater has formed a weak drive bubble. Alternatively, if the impedance measurement at nine microseconds (708) is at a maximum value, corresponding to a hundred percent surface area coverage on the y-axis (702), this will indicate that the nozzle has an unhealthy condition of either a blocked nozzle or the presence of a stray bubble.

Upon indication that there is an unhealthy nozzle condition, a processor may determine to make a remedial action. For example, the processor may determine to increase the energy applied to the heater to compensate for a weak bubble formation. Also, the processor may determine to inactivate the nozzle, send an issue notification, compensate for the nozzle's condition by instructing another nozzle to perform the unhealthy nozzle's job, initiate other remedial actions, or combinations thereof.

In some examples, circuitry converts the measurements into binary data. For example, a "1" may represent a high impedance measurement while a "0" may represent a low impedance measurement. In this manner, the measurements may be simplified for use with logic and simplify processing circuitry.

An impedance sensor in accordance with the principles described herein may take measurements within a two microsecond margin of error or less. Thus, the measurements taken are accurate enough to measure impedance values within the narrow time frame needed to distinguish between healthy and unhealthy nozzle conditions.

Figure 8:
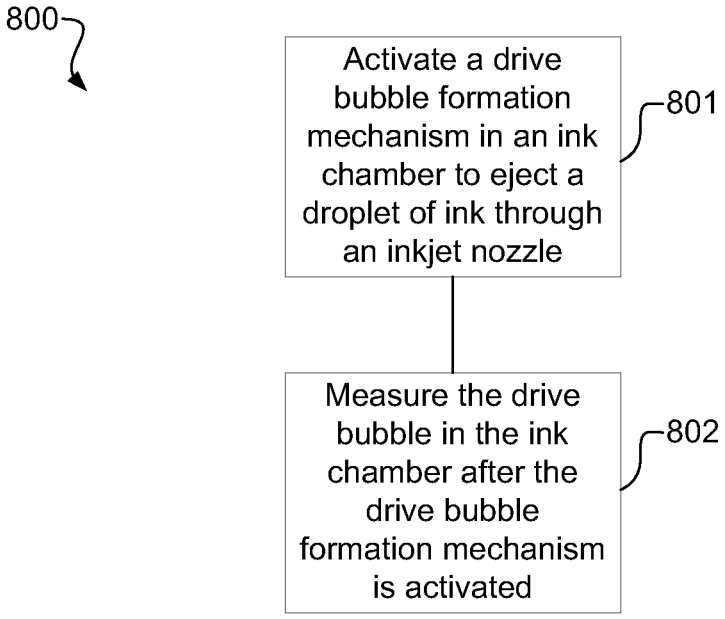
FIG. 8 is a diagram of an illustrative method for determining an issue in an inkjet nozzle, according to principles described herein.

FIG. 8 is a diagram of an illustrative method (800) for determining an issue in an inkjet nozzle, according to principles described herein. In this example, the method (800) includes activating (801) a drive bubble formation mechanism in an ink chamber to eject a droplet of ink through an inkjet nozzle and (802) measuring the drive bubble in the ink chamber after the drive bubble formation mechanism is activated.

The method may be employed on an actual printing job. In this manner, issues may be detected in real time and avoid wasting time and resources if an issue develops during a printing job. Also, the method may take just a few microseconds to perform and may be repeated often without interfering with the printing process. Further, multiple nozzles may be diagnosed during the print job. Additionally, the method may seem transparent to the user.

Further, the method may be employed during a servicing event as well. A servicing event may take place during, before, or after a printing job. To prevent liquid ink from drying in and around the nozzle passage, the nozzle may be fired into a service station. In examples where the print head scans across the printing medium's swath, the service station may be located to the side of the swath. The print head may dock at the printing station during a printing job as needed and/or the print head may dock at the service station when the print head is not in use. While docked, the print head may fire a single nozzle at a time to determine a health issue with that nozzle. By firing a single nozzle at a time, misreads from other nozzles being evaluated at the same time may be reduced. In some examples, some or all of the nozzles may be fired in a particular sequence to control the spacing and reduce interference with the diagnosis of other nozzles. In examples, where the print head remains stationary with respect to the swath of the printing medium, a service station may move to the print head for servicing as needed.

The method may be performed with stationary nozzles arrays or with print heads that traverse the printing medium's width during a print job.

The drive bubble formation mechanism may be a heater or other mechanism capable of creating a drive bubble within the ink chamber. The measurement may be taken with an impedance sensor that is capable of measuring resistance, impedance, or combinations thereof. The measurement may be taken within 0.01 to thirty five microseconds after activating the drive bubble formation mechanism. Also, the sensor may be placed within a region of the ink chamber where the ink bubble is expected to exist.

The method may further include determining whether an issue exists based on the measurement on the drive bubble. The issue that the method may determine may be a blockage of the nozzle, a formation of a weak bubble, a presence of a stray bubble, a blockage of a chamber inlet, or combinations thereof.

The method may also include initiating a remedial action with a processor in response to an issue. The remedial response may include using a second inkjet nozzle to compensate for the issue. In some examples, more than one additional nozzle may be used to compensate for the issue. In examples where the print head slides across the swath of the printing medium, the compensating nozzle or nozzles may be located on any portion of the print head. In examples where an array of nozzles is stationary with respect to the swath of the printing medium, the compensating nozzles may be located before or after the nozzle along a pathway traveled by the printing medium. In some examples, the compensating nozzle is a back-up nozzle intended for use when a primary nozzle has an issue. In alternative examples, the compensating nozzle is already operating and picks up additional tasks for the unhealthy nozzle in addition to the tasks already assigned to the compensating nozzle.

Another remedial action may include sending a notification about the issue. The notification may be sent to a printer operator, a maintenance service provider, a data base, a remote location, or combinations thereof. The nozzle may be disabled until the nozzle receives the needed attention. In some examples, the processor determines if the nozzle may still function for a time despite having an issue. The processor may determine to take no action or wait to make a remedial action.

In some examples, the printer already has built—mechanisms and/or procedures to deal with blocked nozzles, stray bubbles, weak bubble formations, blocked inlets, other issues, or combinations thereof. These built-in mechanisms may be performed automatically by the printer or print head without the assistance of a printer user or repair person.

Figure 9:
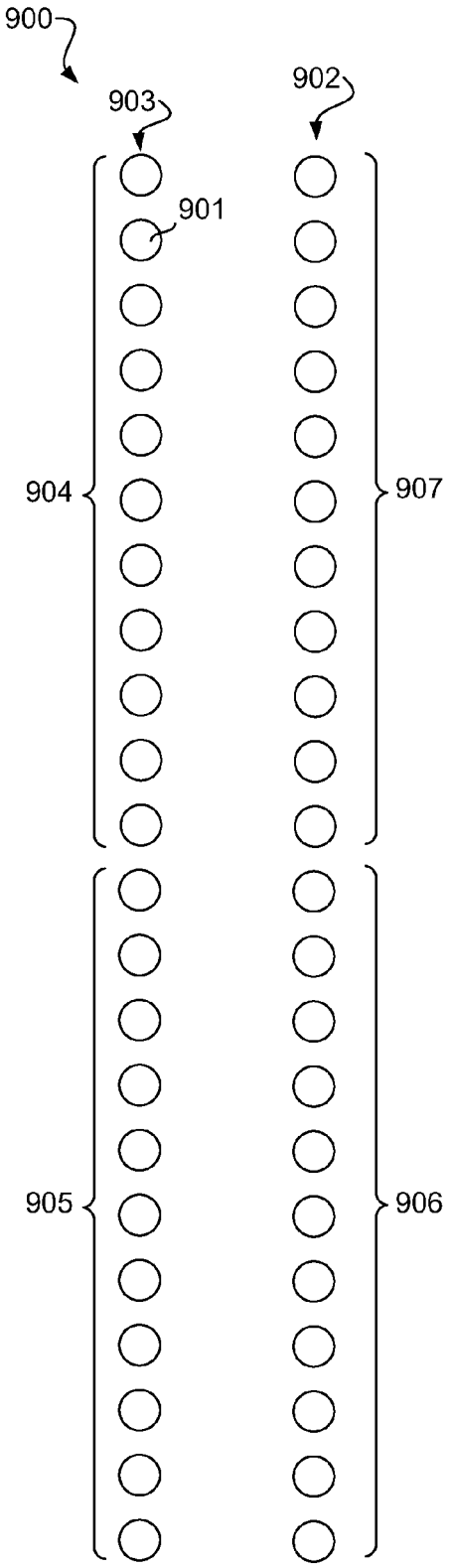
FIG. 9 is a diagram of an illustrative arrangement of inkjet nozzles, according to principles described herein.

FIG. 9 is a diagram of an illustrative arrangement (900) of inkjet nozzles (901) on an underside of a print head, according to principles described herein. In this example, the nozzles (901) are arranged in two columns (902, 903). In other examples, the print head has any number of desired columns of nozzles. Each of the nozzles may have a drive bubble formation mechanism, such as a heater or piezo-electric element, and a sensor. Both the drive bubble formation mechanism and the sensor may be activated with similar circuitry.

The nozzles in each column (902, 903) may be grouped into primitives (904, 905, 906, 907). In some examples, just one drive bubble formation mechanism or nozzle within a primitive (904, 905, 906, 907) is activated at a time. In the example of FIG. 9, each primitive has eleven nozzles. However, in other examples, a primitive may have any amount of desired nozzles. The grouping on nozzles into primitives may simplify circuitry for firing nozzles and taking measurements.

Figure 10:
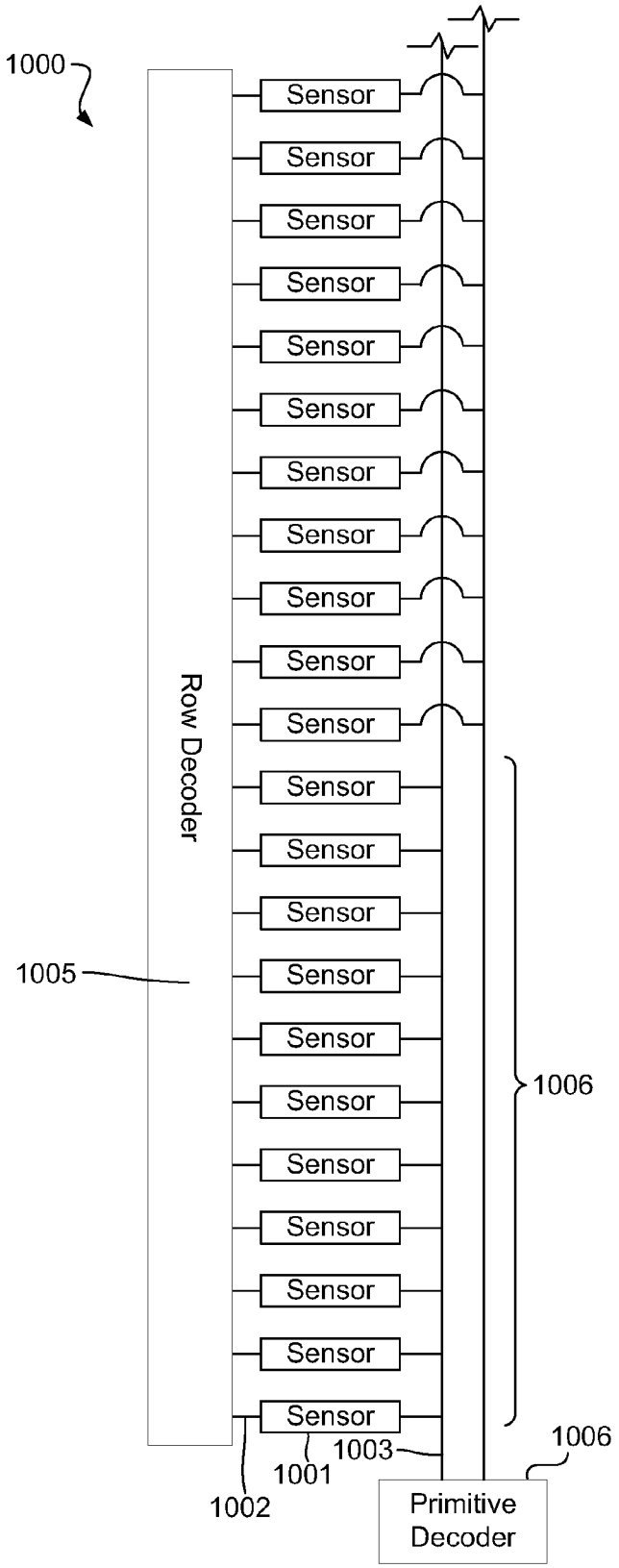
FIG. 10 is a diagram of illustrative circuitry to activate sensors, according to principles described herein.

FIG. 10 is a diagram of illustrative circuitry (1000) to activate sensors (1001), according to principles described herein. In this example, each of the sensors (1001) is located within an ink chamber associated with a nozzle. Each sensor is also addressable by being connected to a row conductor (1002) and a primitive conductor (1003). When a processor sends an instruction signal to a sensor (1001) to take a measurement, the correct sensor may be located by applying a voltage to the appropriate row conductor (1002) and primitive conductor (1003).

In the example of FIG. 10, when the primitive decoder (1004) applies a voltage to primitive conductor (1003), the voltage is applied to all of the sensors in the primitive (1006) since all of the sensors are connected in parallel to the common primitive conductor (1003). However, the applied voltage is too low to sufficiently activate the sensor (1001) alone. The row decoded (1005) may also apply a voltage to the appropriate row conductor (1002) to provide the remaining energy needed to active the sensor (1001).

The row conductor voltage and the primitive conductor voltage may have opposite polarities to drive a current through the sensor (1001) in the same direction. The combination of the voltages may be sufficient to activate the desired sensor (1001). After the signal travels through the sensors, the signal may be routed to a multiplexer to be directed to a processor or other sensing unit for reading the measurement.

Figure 11:
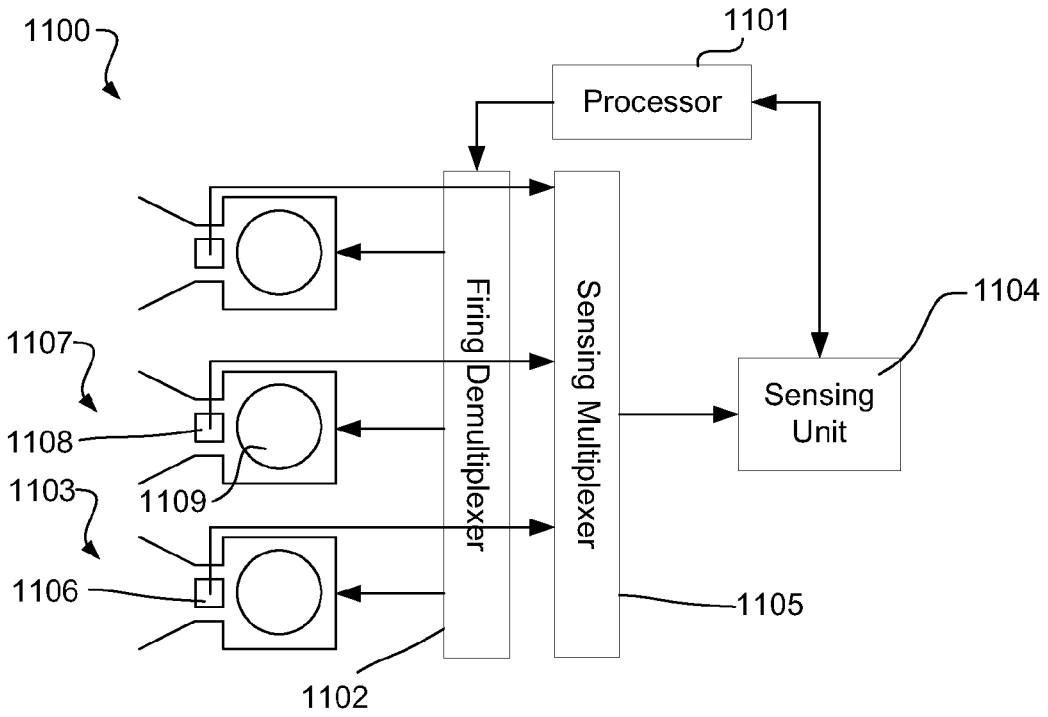
FIG. 11 is a diagram of illustrative circuitry to take measurements, according to principles described herein.

FIG. 11 is a diagram of illustrative circuitry (1100) to take measurements, according to principles described herein. A processor (1101) may control the timing for both firing the nozzle and taking measurements within the ink chamber. In the example of FIG. 11, a processor (1101) is in communication with a firing demultiplexer (1102), which directs a firing command from the processor (1101) to the predetermined nozzle (1103). When the predetermined nozzle (1103) receives the firing command, the drive bubble formation mechanism, such as a heater, initiates the formation of a drive bubble in the ink chamber. The processor (1101) may also send a measurement command to the predetermined nozzle (1103) to take a measurement with the sensor (1106) in the ink chamber after the firing command is sent. In some examples, the measurement command is sent between 0.01 and thirty five seconds after the firing command is sent.

In some examples, an amplifier is included in the circuitry to amplify the measurement signal. Also, a digital-to-analog converter may convert the commands into an analog signal for taking the measurement, and an analog to digital converter may convert the measured signal back into a digital signal for processing.

The measurement taken in response to the measurement command may be sent to a sensing multiplexer (1105) that routes the measurement information to a sensing unit (1104) to interpret the information. The processor (1101) may also be in communication with the sensing unit (1104). The sensing unit (1104) may notify the processor (1101) that an issue exists when such an issue is discovered. In some examples, the processor (1101) notifies the sensing unit (1104) of the firing and measurement commands so the sensing unit (1104) may determine with greater accuracy which nozzle has the issue.

In some examples, the processor (1101) initiates a remedial action in response to discovering an issue. In some examples, the sensing unit (1104) initiates the remedial action. In some examples, the processor (1101) discontinues to send firing commands to the nozzle (1103) to effectively disable the nozzle (1103) until the issue is resolved. In some examples, the remedial action includes using a second nozzle (1107) to perform the functions that nozzle (1103) would have otherwise performed in the absence of an issue. The second nozzle (1107) may also have a sensor (1108) located in a second ink chamber (1109) in fluid communication with the second nozzle (1107). In some examples, more than one additional nozzle may be used to compensate for an unhealthy nozzle.

Due to the circuitry's compact nature in the example of FIG. 11, the circuitry may be formed on a small processing die. In some examples, circuitry (1100), as described, may fit on a die with a width of less than fifty micrometers and a height of less than two hundred micrometers. In some examples, the circuitry (1100) may fit on a die of twenty five micrometers in width and one hundred sixty micrometers in height. However, any die size, die area, or die dimension may be used.

Figure 12:
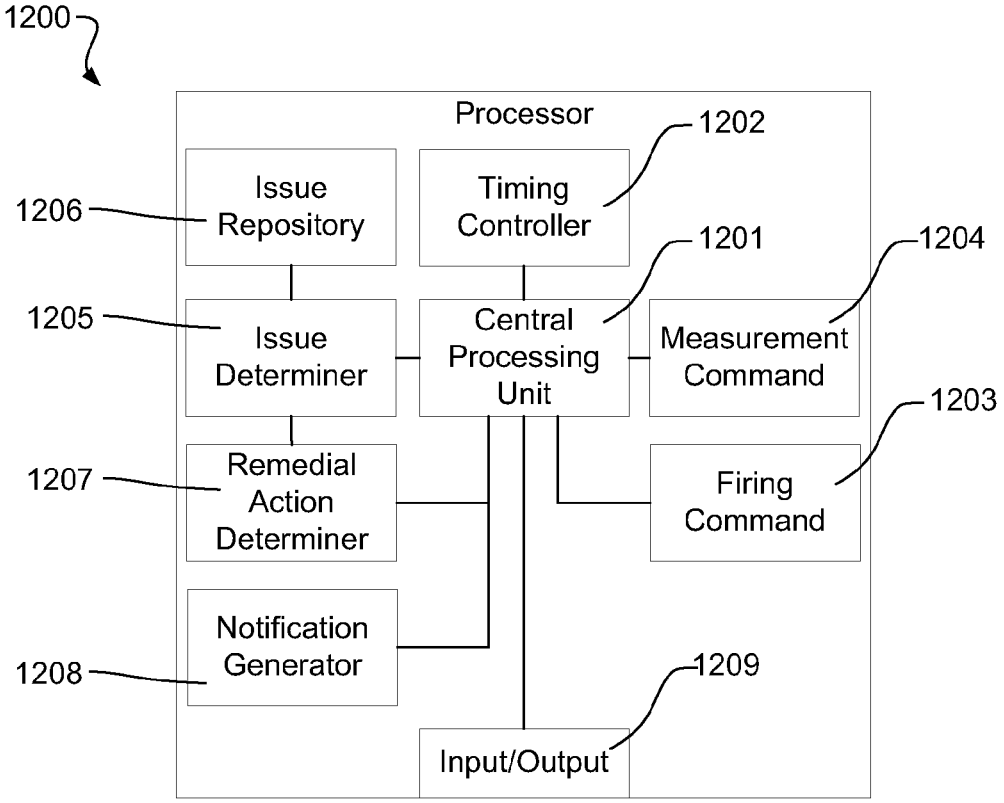
FIG. 12 is a diagram of an illustrative processor, according to principles described herein.

FIG. 12 is a diagram of an illustrative processor (1200), according to principles described herein. In this example, the processor (1200) has a central processing unit (CPU) (1201) that is controlled by a timing controller (1202). The CPU (1201) is in communication with an input/output (1209) to send commands and receive data. The CPU (1201) may communicate with a firing command (1203) to instruct a nozzle to fire by activating a drive bubble formation mechanism. After sending the firing command, the CPU (1201) may communicate with a measurement command (1204) to send an instruction to a sensor located within an ink chamber of the appropriate nozzle.

Upon receipt of the measurement taken in response to the measurement command, the CPU (1201) may send the received measurement to an issue determiner (1205). The issue determiner (1205) may reference an issue repository (1206) that may have a table of measurement values for specific time durations after a firing command is sent. Each of the measurement values for specific times may be associated with a specific type of issue. For example, the table may have multiple impedance values associated with nine microseconds after a firing command is sent. A high measurement value may indicate that there is an issue of a blocked nozzle or the presence of a non-collapsing bubble. A low measurement value at nine microseconds may be associated with the formation of a weak bubble. An impedance measurement between the low and high impedance measurements may indicate that the inkjet nozzle is performing properly.

The issue determiner (1205) may determine that an issue exists or that an issue does not exist. In the situation that the issue determiner (1205) does decide that an issue exists, the determiner (1205) may communicate the issue to the CPU (1201). In some examples, the issue determiner (1205) may communicate to the CPU (1201) the category of issue or specific type of issue determined.

The CPU may send the information about the determined issue to a remedial action determiner (1207) that may determine an action to take in response to the issue determined. The remedial action determiner (1207) may determine to take no action if the issue is minor, if the issue has a minimal affect on the printing job, or if the issue if not yet affecting the print job. The remedial action determiner (1207) may wait to make a decision and instruct the CPU (1201) to request the remedial action determiner (1207) to consider the situation later or request that the nozzle be measured again after sending another firing command.

The remedial action determiner (1207) may also determine to send a notification. When such an action is determined, the remedial action determiner (1207) may send the determined action to the CPU (1201). Upon receipt of a message to send a notification from the remedial action determiner (1207), the CPU (1201) may communicate with a notification generator (1208). The notification may be sent in conjunction with another remedial action determined by the remedial action determiner (1207).

In some examples, the remedial action determiner (1207) also determines whether the unhealthy nozzle is suitable to complete the printing job and may instruct the CPU (1201) to discontinue sending firing commands to the nozzle. The remedial action determiner (1207) may instruct the CPU (1201) to compensate for the unhealthy nozzle with at least one additional nozzle with a healthy condition.

In some examples, the CPU (1201) sends a measurement command after every firing command. In some examples, the CPU (1201) sends the firing command after a predetermined number of firing commands. In some examples, the CPU (1201) sends a measurement command after a firing command to each nozzle on a print head within a certain time period or after a predetermined number of firing commands per nozzle. In some examples, the measurement command is sent randomly.

In some examples, the measurement command is sent at a predetermined time after the firing command is sent. In some examples, the CPU (1201) sends the measurement command at different times following the firing command. In some examples, the CPU (1201) randomly selects a time to send a measurement command to a nozzle after the firing command.

Figure 13:
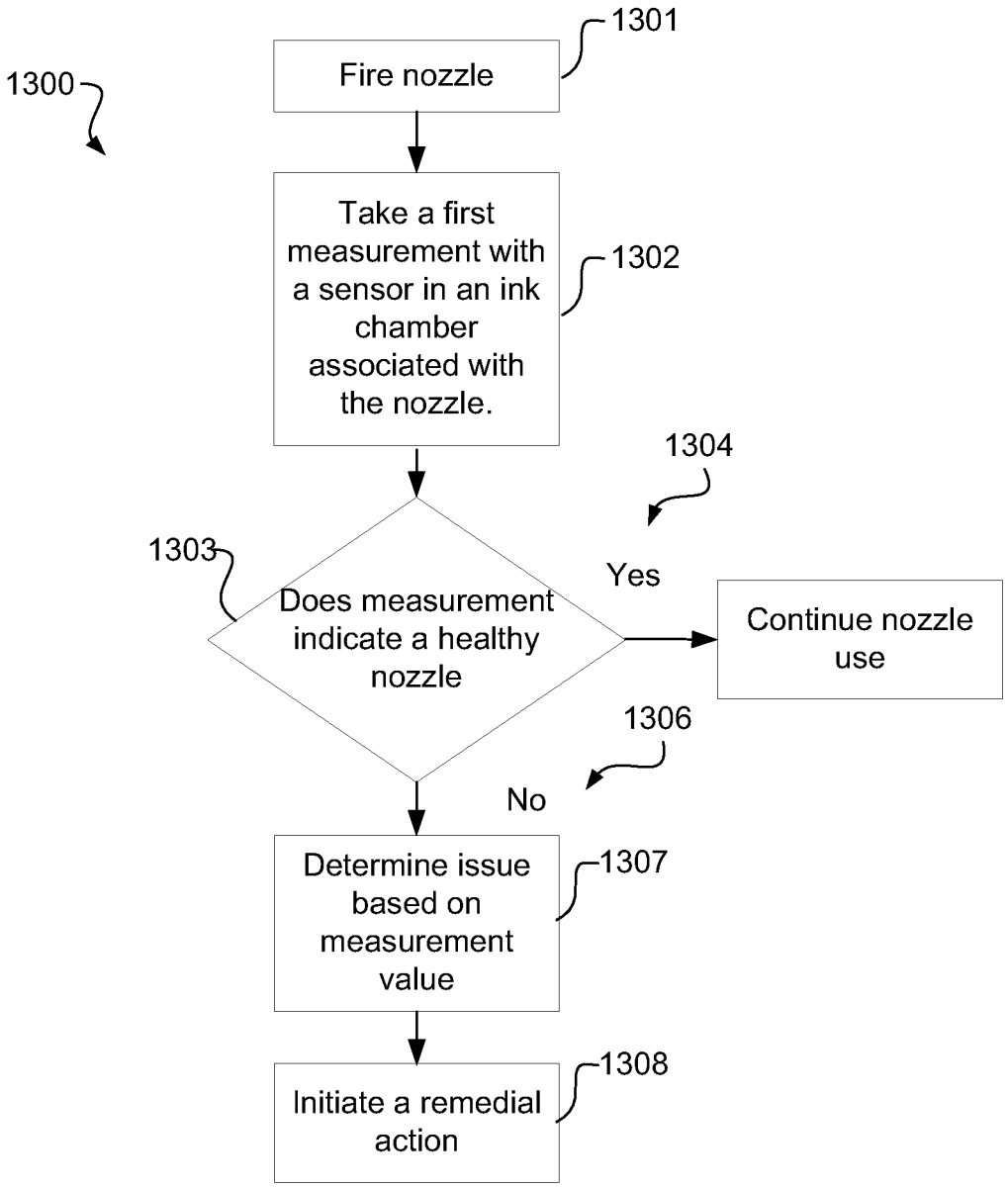
FIG. 13 is a diagram of an illustrative flowchart for determining an issue in an inkjet nozzle, according to principles described herein.

FIG. 13 is an illustrative flowchart (1300) for determining an issue in an inkjet nozzle, according to principles described herein. In this example, the method includes firing (1301) a nozzle followed by taking (1302) a measurement with a sensor in an ink chamber associated with the nozzle. The method may also include determining (1303) whether the measurement indicates that there is an issue with the nozzle. If the measurement does indicate that there is no issue (1304), use of the nozzle may be continued (1305).

If the measurement does determine (1306) that an issue exists, the nature of the issue may be determined (1307) based on the measurement value. Once the issue is determined (1307), the method may include initiating (1308) a remedial action appropriate for the determined issue.

While the principles herein have been described with specific ink chamber geometries, drive bubble formation mechanism placements, and sensor placements, any placement of components within the ink chamber and any geometry of the ink chamber are included within the scope of the principles described herein.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method for determining an issue in an inkjet nozzle, comprising:

activating a drive bubble formation mechanism in an ink chamber to eject a droplet of ink through said inkjet nozzle; and measuring said drive bubble m said ink chamber after said drive bubble Ibumation mechanism is activated.

2. The method of claim 1, wherein measuring, said drive bubble in said ink chamber after said drive bubble formation mechanism is activated includes taking an impedance measurement within said ink chamber.

3. The method of claim 1, wherein measuring said drive bubble in said ink chamber after said drive bubble formation mechanism is activated includes taking an impedance measurement within a region of said ink chamber where said drive bubble is expected to exist.

4. The method of claim 3, further comprising determining said issue exists based on said impedance measurement.

5. The method of claim 4, further comprising initiating a remedial action with a processor in response to said issue.

6. The method of claim 5, wherein said remedial action comprises using at least one additional inkjet nozzle to compensate for said issue.

7. The method of claim 5, wherein said remedial action comprises sending a notification about said issue.

8. The method of claim 5, wherein said remedial action comprises disabling said inkjet nozzle.

9. The method of claim 1, wherein said issue is a blockage of said inkjet nozzle, a formation of a weak bubble, presence of a stray bubble, a blockage of a chamber inlet, or combinations thereof.

10. An inkjet print head, comprising;

an ink chamber comprising a drive bubble formation mechanism and an impedance sensor positioned within said ink chamber to detect a presence of a drive bubble;

said impedance sensor to receive commands from a processor programmed to initiate a drive bubble formation within said ink chamber;

said processor being programmed to take an impedance measurement within said ink chamber after initiating a drive bubble formation mechanism and to determine if an issue exists in said ink chamber based on said impedance measurement.

11. The inkjet print head of claim 10, thither comprising at least one additional inkjet nozzle and said processor being programmed to compensate for said issue with said at least one additional inkjet nozzle.

12. A printer, comprising:

a first nozzle in fluid communication with a first ink chamber, said first ink chamber comprising a first impedance sensor;

said first impedance sensor being in communication with a processor;

said processor also being in communication with a first drive bubble formation mechanism in said first ink chamber:

said processor programmed to:

send a firing command to said first drive bubble formation mechanism;

send a measurement command to first impedance sensor after said firing command; and determine a presence of a drive bubble within said first ink chamber based on a measurement taken in response to said measurement command.

13. The printer of claim 12, further comprising:

a second nozzle in fluid communication with a second ink chamber, said second ink chamber comprising a second impedance sensor;

said second impedance sensor being in communication with said processor; and said processor also being in communication with a second drive bubble formation mechanism in said second ink chamber.

14. The printer of claim 13, wherein said processor is programmed to:

determine if an issue exists in said first ink chamber based on said measurement; and instruct said second drive bubble formation mechanism to compensate when said issue in said ink chamber is determined to exist.

15. The printer of claim 13, further comprising:

a print head with a plurality of nozzles, said first and second nozzles being part of said plurality of nozzles:

each nozzle of said plurality comprising an impedance sensor;

each impedance sensor being addressable with a plurality of primitive electrical conductors and a plurality of row electrical conductors;

wherein and said first impedance sensor is in communication with a first row electrical conductor and a common primitive electrical conductor; and and second impedance sensor is in electiical communication with a second row electrical conductor and said common primitive electrical conductor.

* * * * *

UNITED STATES PATENT AND TRADEMARK OFFICE

CERTIFICATE OF CORRECTION

PATENT NO. : 9,044,936 B2
APPLICATION NO. : 14/372697
DATED : June 2, 2015
INVENTOR(S) : Andrew L. Van Brocklin et al.

It is certified that error appears in the above-identified patent and that said Letters Patent is hereby corrected as shown below:

Claims

In column 12, line 1, in Claim 1, delete “m” and insert -- in --, therefor.

In column 12, line 2, in Claim 1, delete “Ibumation” and insert -- formation --, therefor.

In column 12, line 3, in Claim 2, delete “measuring,” and insert -- measuring --, therefor.

In column 12, line 28 approx., in Claim 10, delete “comprising;” and insert -- comprising: --, therefor.

In column 12, line 41, in Claim 11, delete “thither” and insert -- further --, therefor.

In column 12, line 53 approx., in Claim 12, delete “chamber:” and insert -- chamber; --, therefor.

In column 13, line 13, in Claim 15, delete “nozzles:” and insert -- nozzles; --, therefor.

In column 13, lines 21-22, in Claim 15, delete “and and” and insert -- and --, therefor.

In column 13, line 22, in Claim 15, delete “electiical” and insert -- electrical --, therefor.

Signed and Sealed this
Thirty-first Day of May, 2016

Michelle K. Lee

Michelle K. Lee
*Director of the United States Patent and Trademark Office*